US005187950A

United States Patent [19]

Weldon

[11] Patent Number: 5,187,950

[45] Date of Patent: Feb. 23, 1993

[54] DOOR MOUNTED COOLING APPARATUS

[76] Inventor: Mark P. Weldon, 4938 Look Kinney Cir., Liverpool, N.Y. 13088

[21] Appl. No.: 843,223

[22] Filed: Feb. 28, 1992

[51] Int. Cl.[5] ..... F25D 19/00

[52] U.S. Cl. ..... 62/449; 62/263; 49/380

[58] Field of Search ..... 62/263, 259.1, 262, 62/449; 165/53, 54; 49/478, 380

[56] References Cited

U.S. PATENT DOCUMENTS

| | | | |
|---|---|---|---|
| 3,092,979 | 6/1963 | Lamont | 62/239 |
| 3,481,153 | 12/1969 | Hoyle | 62/262 |
| 4,027,498 | 6/1977 | Fessler | 62/263 |
| 4,072,187 | 2/1978 | Lodge | 165/54 |
| 4,581,903 | 4/1986 | Kerry | 62/503 |
| 5,046,327 | 9/1991 | Walker et al. | 165/53 |

FOREIGN PATENT DOCUMENTS

| | | | |
|---|---|---|---|
| 2582043 | 11/1986 | France | 49/478 |

*Primary Examiner*—John Sollecito

*Attorney, Agent, or Firm*—Richard C. Litman

[57] ABSTRACT

A self contained, mechanical cooling apparatus is mountable on a door which is pivoted on hinges to a door frame. The door may be mounted for either exterior or interior service in a residential or commercial setting. The door frame is attached to the building structure in a conventional manner. The door provides a closure for a designated room and the door mounted cooling apparatus maintains the desired, generally lower, temperature in the room. Major cooling components mounted in the door include a refrigerant compressor, evaporator coil, condenser coil, accumulator, capillary tubing, refrigerant piping and electrical components. The parts are enclosed in a one piece, premolded plastic apparatus housing. Two supply air fans are mounted within the housing, and molded in supply and return air grilles communicate with the enclosed space. Two condenser air fans are mounted within the housing and circulate air to and from the condenser coil through a multidirectional air louver mounted on the exterior surface of the doors.

6 Claims, 5 Drawing Sheets

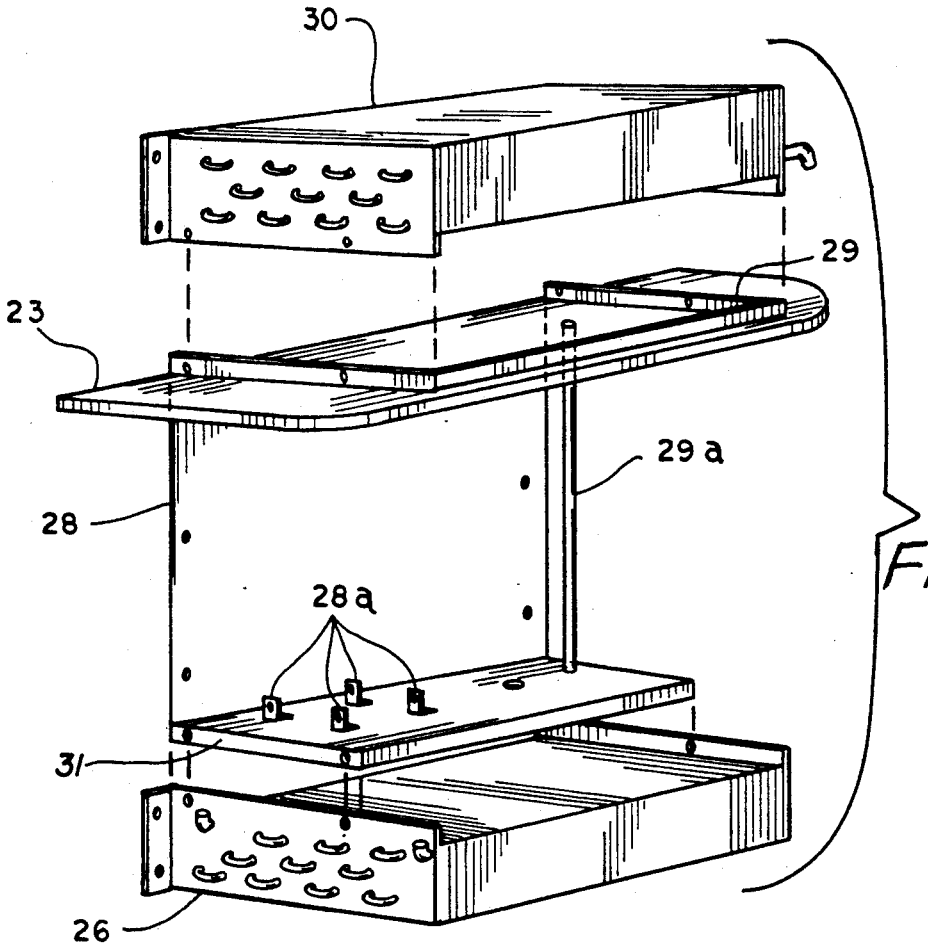
FIG. 4
FIG. 5
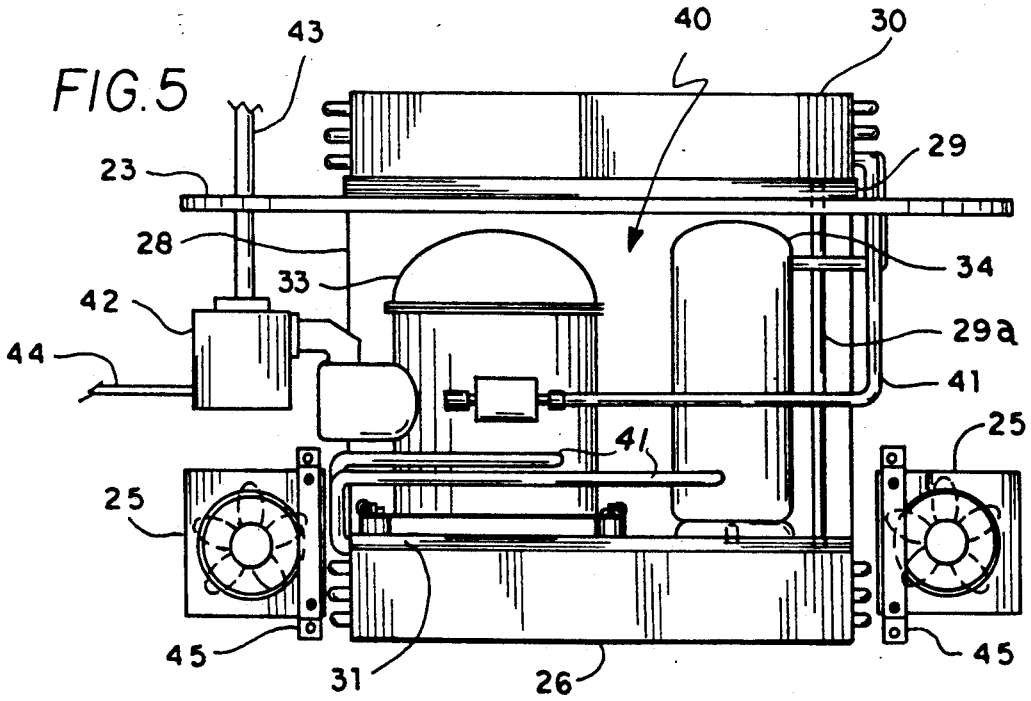

FIG. 7
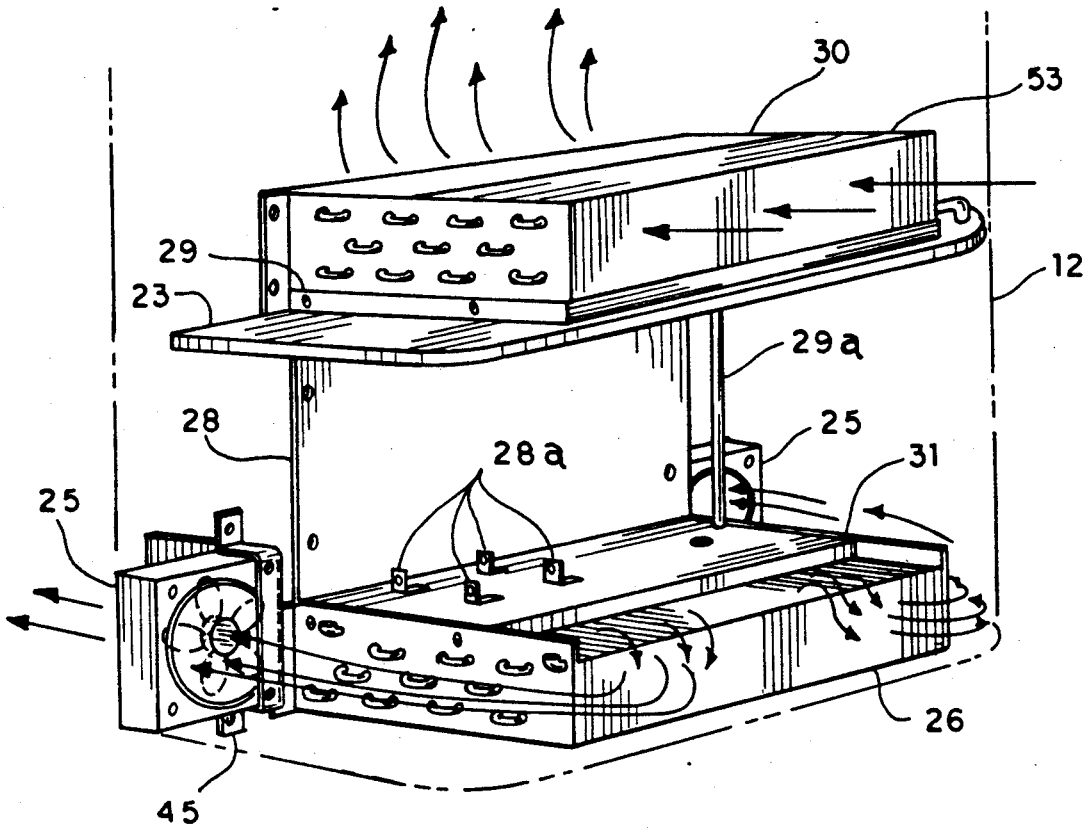
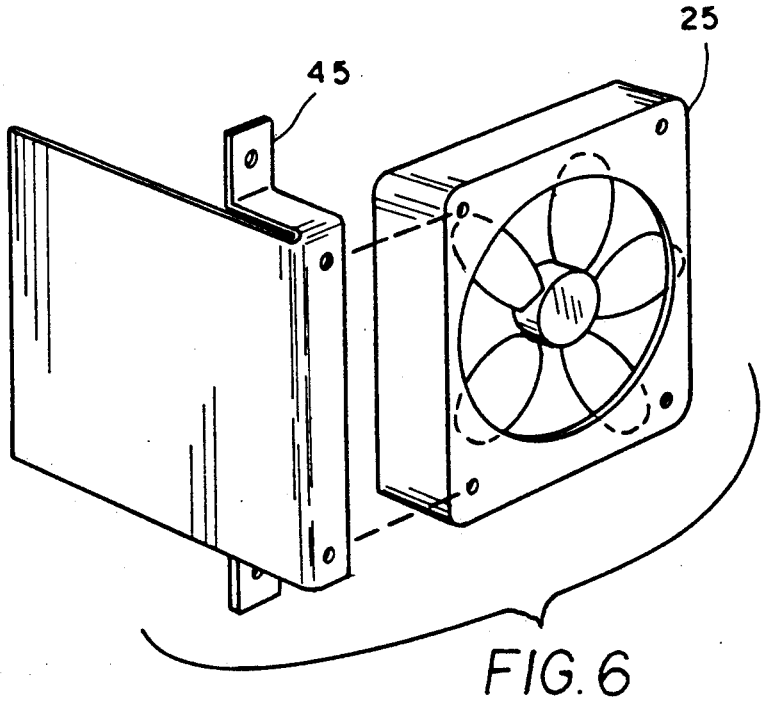
FIG. 6

30
40
18
52
18
12
51
50
44
4
34
41
43
33
25
25
26

DOOR MOUNTED COOLING APPARATUS

BACKGROUND OF THE INVENTION

1. Field of the Invention

This invention relates to air conditioning systems and, in particular, to air cooling-units that are furnished, factory installed, on doors of any dimensions.

2. Description of the Prior Art

There is considerable prior art in the general area of small, self contained air conditioning systems, including systems which are specific to residences, but little in the area of the instant invention, which provides a completely, self contained, door mounted air cooling system, needing nothing more than connection to a source of electric power. The invention has application wherever it is desired to maintain a cool temperature in a designated room, whether in residential, commercial or industrial settings, or in vehicles.

In seeking most cost effective ways to cool selected, enclosed spaces for purposes of storing food, flowers, chemicals, furs or similar commodities or materials, it was apparent that the cost of a permanent installation of a self contained air cooling system of even modest capacity, was excessive. This was due to the fact that the construction cost of the installation often exceeded the apparatus cost and was, therefore, the largest cost factor. However, the prior art does disclose efforts in this area.

U.S. Pat. No. 3,481,153 issued Dec. 2, 1969 to Walter W. Hoyle discloses a specific improvement in the construction of window type air conditioners, which are widely used, generally, to air condition a specific room, or contiguous spaces in a residence. This unit is not taught as being mountable on a door surface.

U.S. Pat. No. 4,072,187 issued Feb. 7, 1978 to Robert H. Lodge teaches a compact heating and cooling system of slim design which is constructed to be mounted, either free standing parallel a wall or, alternately, mounted within a wall. The system functions to air condition/heat either a designated room, or a room and contiguous areas in a residence. This system requires extensive construction work to mount it in a wall between wall studs. If the unit is optionally mounted free standing parallel a wall, it takes up valuable floor space in a small storage room. The system does not offer an optional mounting on a door surface.

U.S. Pat. No. 5,046,327 issued Sep. 10, 1991 to Steve A. Walker discloses an air conditioner conversion kit intended to be mounted on the rear entrance door of a recreational vehicle. Components of the air conditioner are mounted on both sides of and through the recreational vehicle door, which requires extensive modifications to accommodate the apparatus. The conditioner cannot be mounted entirely on the inner surface of the door, as is the case in the instant invention.

U.S. Pat. No. 3,092,979 issued Jun. 11, 1963 to John Lamont discloses a basic refrigeration apparatus mounted and contained with a sliding door on a refrigerated railroad car. The construction allows the sliding door to function as originally intended. However, the assembly requires a supplementary air distribution system within the car in the form of air plenums and air circulation fans. In the present invention, the cooling apparatus including air distribution is entirely self contained on the door, and can provide adequate air circulation in a space whose wall is up to twelve feet from the door.

It is apparent from the above prior art discussion that the concept of a complete self contained air cooling system, furnished factory mounted on a door of any required dimension, is novel.

Thus, none of the above inventions and patents, taken either singly or in combination, is seen to describe the instant invention as claimed.

SUMMARY OF THE INVENTION

Since all enclosed spaces have at least one feature in common, a doorway with a door, a novel solution to reducing the installation cost is to furnish a small, self contained air cooling system mounted complete on a prehung door, that is, a combination door frame, door and cooling unit, ready for installation at the doorway of a designated closed space. By being part of the door, the refrigeration system does not require the piercing of the floor, wall or ceiling at the job site, to have the evaporator components in the cooled space. Since the factory assembled cooling system is entirely prepiped, charged and prewired, no field assembly of the refrigeration system is required. Only a single connection to external electric power is required to place the unit in operation.

Accordingly, it is a principal object of the invention to provide a completely self contained air cooling system, factory piped and prewired, permanently mounted on a prehung door of dimensions standard to residential and/or commercial applications, where a prehung door consists of both a door and door frame, although doors and frames of custom dimensions could be furnished.

It is another object of the invention to provide a complete self contained air cooling system factory mounted and furnished on a door that has been manufactured to dimensions compatible with an existing door frame in either a residential or commercial setting.

It is a further object of the invention to provide a door that can be mounted at building interior or exterior locations and can be either right hinged or left hinged as required.

Still another object of the invention is to provide additional cost savings in new construction, inasmuch as the prehung door and door frame assembly can be installed without removal of any existing building structure.

Yet a further object of the invention is to permit a simple and economical conversion of a closed space as small as a closet to a cooled air storage space by installation of this invention.

It is an object of the invention to have the cooling unit occupy otherwise unoccupied volumetric space, i.e., the space directly behind a door, which usually opens to an aisleway or cleared space; when the door is opened, the cooling apparatus is swung clear of the entry way.

It is another object of the invention to provide for a multifunction equipment bracket illustrated herein.

Still another object of the invention is the design of a multifunction housing, molded of one piece plastic material, in which the molded supply air grille is located high on the side of the housing while the molded return air grille is located low on the side of the housing, thus allowing adequate cooled air circulation throughout the cooled enclosed space.

It is a further object of the invention to permit the incorporation of integral lighting or shelving on a forward face of the apparatus housing.

It is still another object of the invention to provide a safety closure system for a conventional steel door and frame, which includes a perimeter gasket of magnetic adhering material, mounted at the door-to-frame ledge, so the door may be opened easily from either side by application of a minimal force, while still maintaining an adequate seal against air leakage.

It is yet a further object of the invention to provide a door mounted air cooling system, in which may be incorporated standard lockset hardware, and at entrances to larger rooms, where an astragal strip is installed to separate double doors, each door may support a door hung air cooling unit.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is an exploded perspective view of the multifunction bracket which supports most of the major mechanical components of the invention;

FIG. 5 is an elevational view of the major components of the refrigeration system;

FIG. 6 is an exploded perspective view of the mounting bracket and air baffle assembly which supports each condenser fan;

FIG. 7 is a perspective view of the airflow paths at the unit evaporator and condenser coils, respectively;

Similar reference characters denote corresponding features consistently throughout the attached drawings.

DETAILED DESCRIPTION OF THE PREFERRED EMBODIMENT

Figure 1:
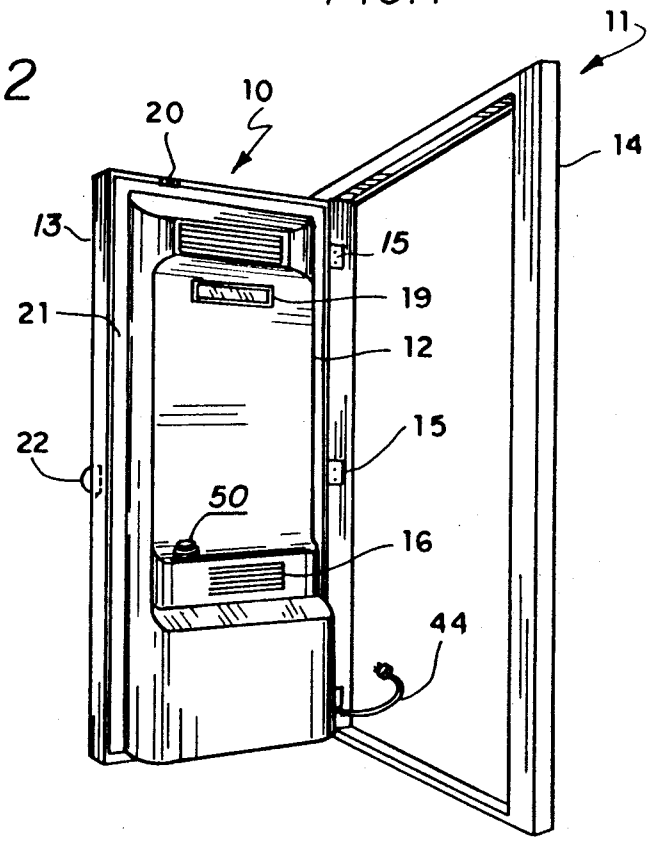
FIG. 1 is a perspective view of the apparatus of the invention, as viewed with the door opened to the cooled space.

The apparatus of the present invention is generally indicated at 10 in FIG. 1, mounted in an existing wall structure 11 of a type that is normally found in buildings. The apparatus 10 includes a refrigerating unit and apparatus enclosure 12 mounted on a prehung door 13, which is supported from the door frame 14, by a plurality of conventional hinges 15. The preferred embodiment would incorporate a steel insulated door and steel frame, although doors of other construction could be employed.

It is intended that the invention 10 will replace in its entirety an existing door and frame at the designated location where a cooled, or heated, room is required. Both interior and exterior doorways are applicable. Doors may be right hinged or left hinged; an alternate embodiment would be furnished without the premanufactured door frame 14. The hinged door 13 would be adapted, as manufactured, to suit the existing door frame. Methods of installing replacement door frames are well known in the carpentry art and therefore do not form part of the claimed invention, per se. A simple remote bulb thermostat 50 with control, mounted on the apparatus enclosure, operates to cycle the compressor and fans to maintain temperature in the conditioned space.

Figure 2:
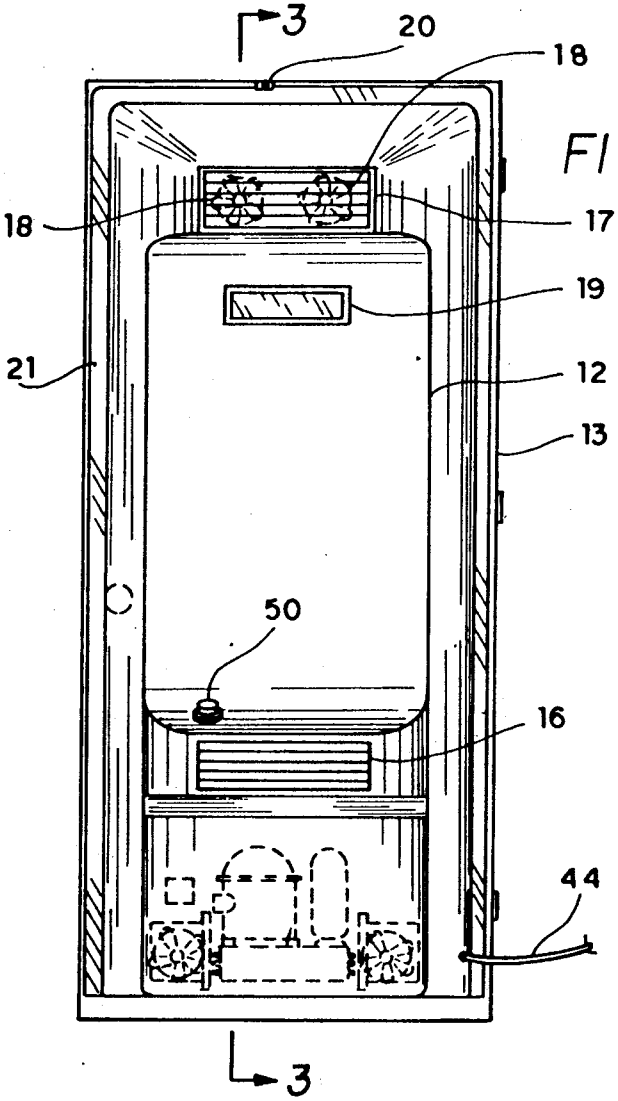
FIG. 2 is an interior, elevational view of the door, showing supply and return air openings, an integral light fixture, and a thermostat control.

In FIG. 2, the apparatus enclosure 12 will be of one piece molded construction, using ABS plastic material or the like. Premolded louver type openings 16 in the face of the apparatus enclosure 12 provide a return air path to the conditioning apparatus, while integral molded supply louvers 17, in conjunction with one or a plurality of compact electric air fans 18, project the conditioned air into the cooled space. An optional lighting fixture 19 is shown, operable by a door switch 20, which provides illumination when the door is opened. The described apparatus enclosure may also include molded in shelving on the front surfaces, or mountings for adjustable shelving. Slotted shelving strips may be mounted on the door, on each side of the enclosure, to support movable shelves. The door 13 may be made of metal and optionally supplied with a readily available magnetic gasket 21 which, by holding the door closed under light contact pressure, provides a safety feature against a person becoming locked in the conditioned space. A non-engaging door knob 22 can be mounted on the door exterior. Alternately, the invention can be configured to incorporate standard locking door hardware.

The apparatus enclosure 12 will have those interior surfaces located below the insulating partition 23 (see FIG. 2) insulated with soft blanket type insulation 24. Compact type air fans 25 exhaust air from the condenser coil 26 area through stamped grille 27, mounted on the exterior of the door.

FIG. 4 illustrates the multifunction mounting bracket 28. Bracket 28 mounts, with screw fasteners, to the interior surface of the door 13. Upper shelf 29 supports insulating partition 23 and evaporator coil 30 and also acts as the condensate pan. Condensate drain tube **29*a* leads condensate down to condenser coil 26** where the condensate serves to increase the coil efficiency through wetting action and evaporation from the coil fins.

Lower shelf 31 supports condenser 26 and, as shown in FIG. 5, also supports the refrigerant compressor 33 on the four mounting tangs **28*a*, and also the accumulator 34**.

FIG. 5 illustrates the compact refrigeration assembly 40, with major components supported generally on the multifunction bracket 28, these being compressor 33, accumulator 34, eyaporator coil 30, condenser coil 26, major refrigerant tubing 41, electrical junction box 42, internal power and control wiring 43, and cable 44, which is connected to an external power source (not shown). Fans 25 are independently mounted.

In FIG. 6, it can be seen that compact condenser fans 25 are supported on separator brackets 45. Screws are used to fasten bracket 45 to fan 25 and to door 13. Right hand and left hand brackets, one each, are required to separate the supply and return air paths to the condenser coil.

Figure 9:
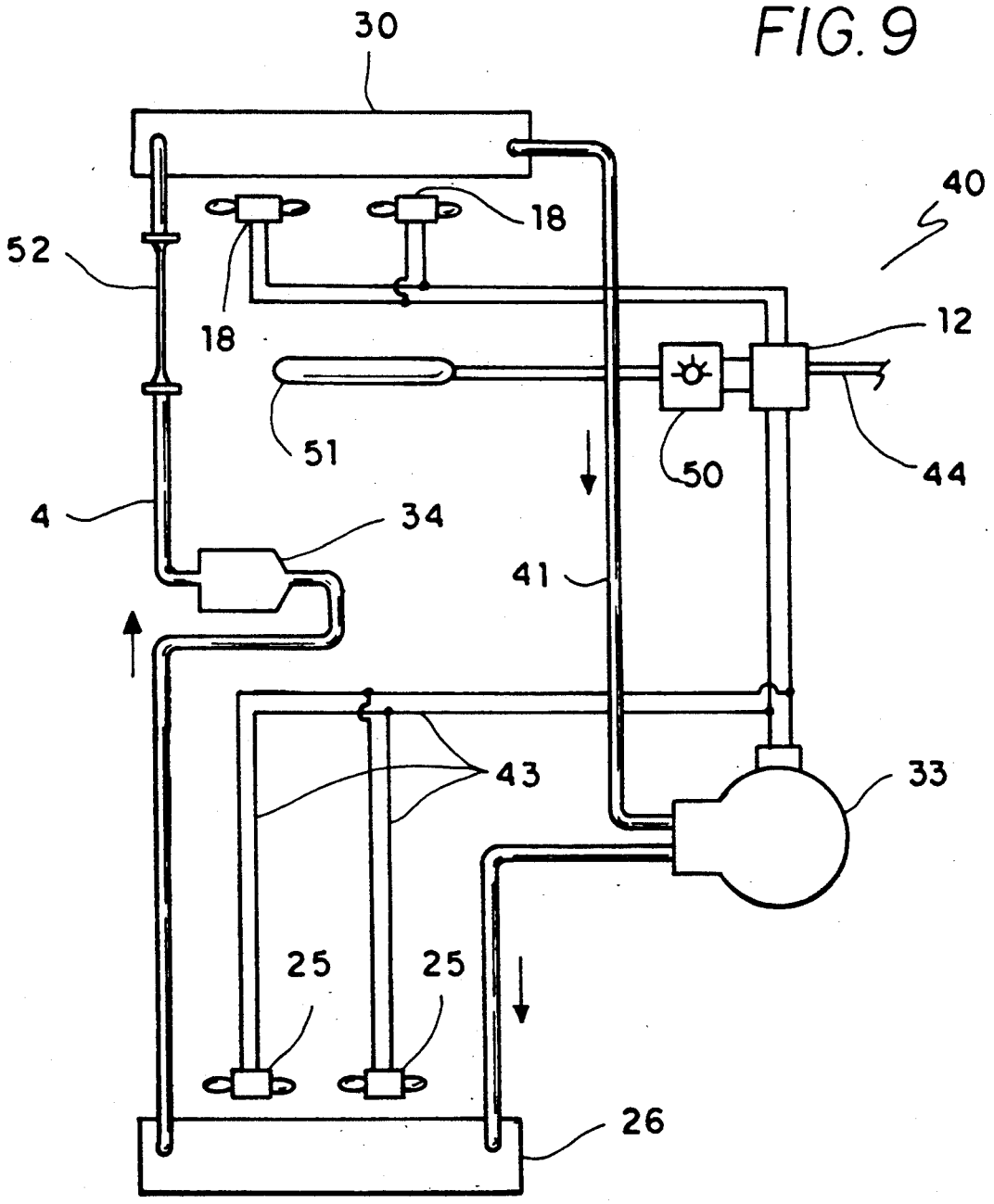
FIG. 9 is a schematic flow diagram of the refrigeration system combined with a unit wiring diagram.

FIG. 9 illustrates the electrical wiring and refrigerant flow diagram, for an air conditioning mode; some features are known in the art. Line voltage remote bulb thermostat 50, mounted on the apparatus enclosure 12, cycles the refrigerant compressor 33, simultaneously with air fans 18 and 25, to maintain space temperature. Thermostat remote sensing bulb 51 is located inside the apparatus enclosure behind the return air louver openings 16 (see FIG. 1). Upon signal from thermostat 50, compressor 33 circulates hot compressed gas to condenser 26, where it is condensed to a warm liquid. Liquid refrigerant circulates through accumulator 34, thence through restricting capillary tube 52 to evaporator coil 30 where low pressure expanding gas absorbs heat from the conditioned air being circulated by supply air fans 18. Warmed refrigerant gas from the evaporator 30 circulates to the compressor 33 to complete the cycle.

It is to be emphasized that, as an alternative to the cooling system shown, a heat pump system (not shown) could be substituted to provide a heating function, where ambient air conditions could allow an economical heat pump installation. It is envisaged that the external appearance of the refrigerator-door assembly would be unchanged by increasing the capability to that of a heat pump.

FIG. 7 illustrates the novel air flow paths through the evaporator 30 and condenser coil 26, respectively. A blocking baffle 53 (see FIG. 7) on the topside of evaporator coil 30 confines the air entering through air louver 16 (see FIG. 1) to a right angled turn, thence upwards in the apparatus enclosure 12, to the air supply fans (see FIG. 2). The insulating partition 23, seen in FIG. 3, separates the conditioned air entering evaporator coil 30 from the exterior air entering and circulating through condenser coil 26.

Figure 3:
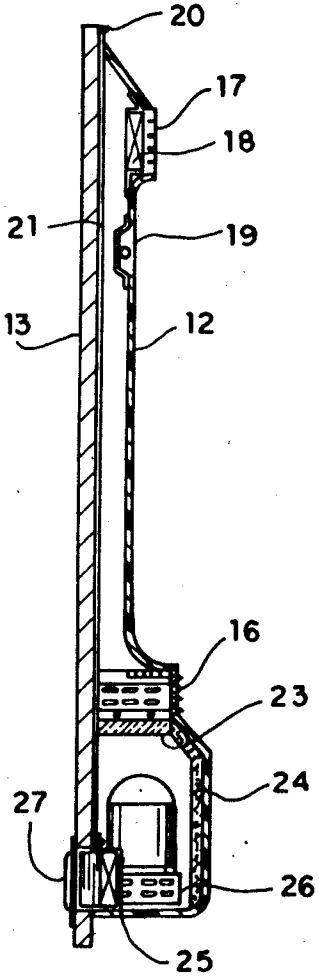
FIG. 3 is a sectional view taken along lines 3—3 of FIG. 2.
Figure 8:
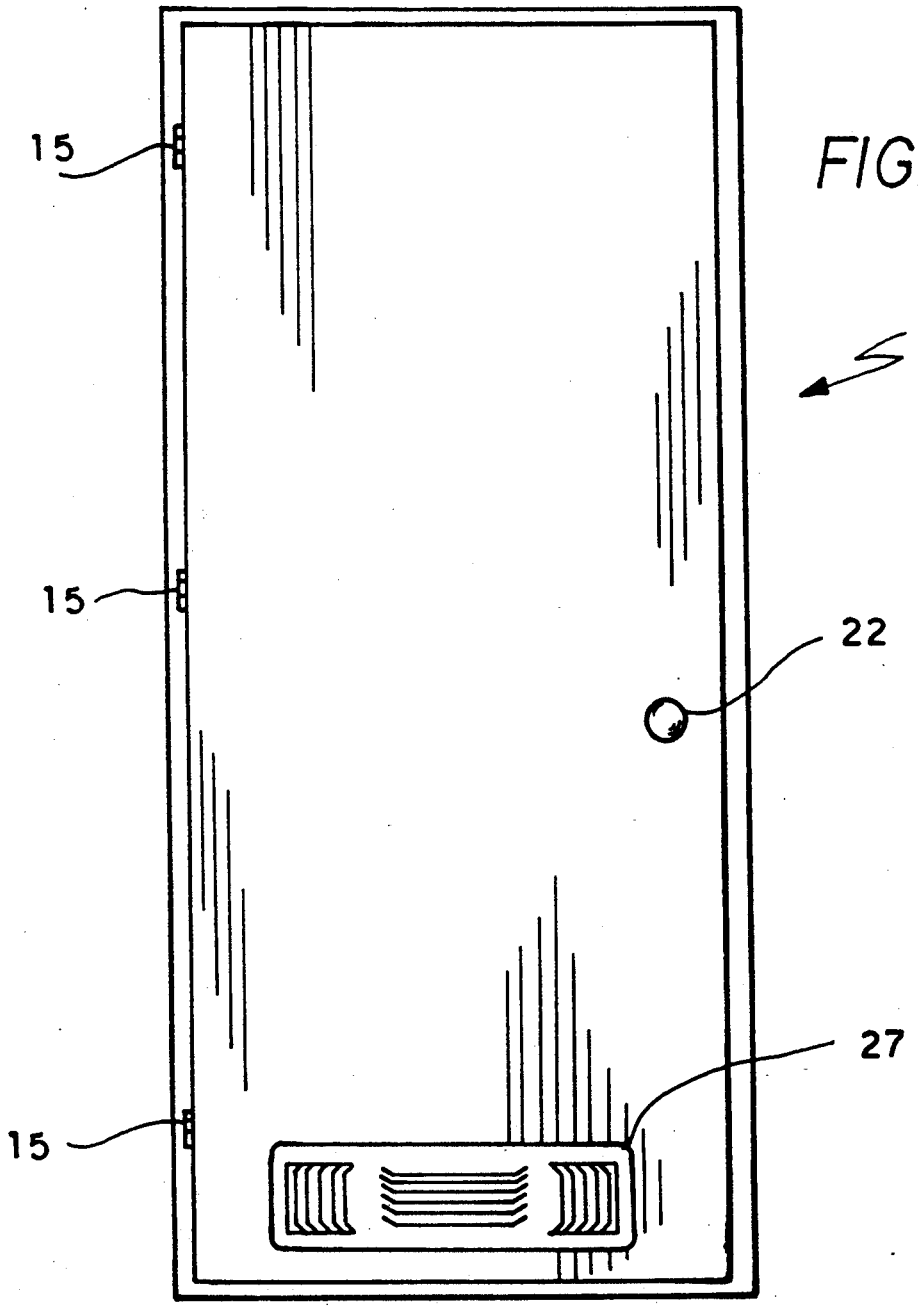
FIG. 8 is an exterior elevational view of the door closed to the cooled space, showing the combined air intake and discharge grille structure which serves the condenser coil.

At the condenser coil 26, air emerging from the top and rear of the coil, as shown, has entered from the exterior space through the horizontal air openings of door louver 27, seen in FIG. 3. Compact fans 25 pull this air through the coil 26 and exhaust it through the angled, vertical air openings of the same door louver 27. The lower shelf 31 of bracket 28 provides a blocking function at the upper surface of condenser coil 26 to restrict air entering this coil to flow from front of the coil to the rear as shown. The condenser airflow path thus described is also bounded by the proximity of the apparatus enclosure 12, seen in FIG. 1, and the outline of which is more clearly indicated in FIG. 7.

It is to be understood that the present invention is not limited to the sole embodiment described above, but encompasses any and all embodiments within the scope of the following claims.

I claim:

1. A door mounted apparatus for the cooling of air within an enclosed space accessible by means of said door, said apparatus including components comprising:

at least a refrigerant compressor, refrigerant condensor and evaporator coils, thermostatic switch, accumulator, refrigerant, and electrical connecting means for said apparatus;

a bracket secured to an inner surface of said door, said bracket providing for the support and attachment of at least said compressor, said condenser and evaporator coils, and said accumulator to said door inner surface;

at least one electrical fan providing for the circulation of air through said evaporator coil and said enclosed space;

at least one electrical fan providing for the intake of air outside said enclosed space and the exhaust of air heated by said condensor coil;

passage means through said door defining both an inlet for outside air and an outlet for said heated air, whereby said apparatus is mounted to said door and actuated to provide cooled air within said enclosed space; and said door includes a prefabricated frame, said frame being installable in an opening provided therefore.

2. The invention as claimed in claim 1 including sealing means around the periphery of said door.

3. The invention as claimed in claim 2 wherein said sealing means are magnetic.

4. The invention as claimed in claim 1 including a housing providing protection and concealment for said components.

5. The invention as claimed in claim 4 wherein said housing includes a light.

6. The invention as claimed in claim 5, said light including light actuating means operable by the opening of said door.

* * * * *